US006241083B1

(12) United States Patent
Harrelson

(10) Patent No.: US 6,241,083 B1
(45) Date of Patent: Jun. 5, 2001

(54) ARTICLE CARRIER WITH END WINDOWS

(75) Inventor: Glen Ray Harrelson, Gainesville, GA (US)

(73) Assignee: Riverwood International Corporation, Atlanta, GA (US)

( * ) Notice: Subject to any disclaimer, the term of this patent is extended or adjusted under 35 U.S.C. 154(b) by 0 days.

(21) Appl. No.: 09/546,164

(22) Filed: Apr. 11, 2000

(51) Int. Cl.[7] ..... B65D 71/00
(52) U.S. Cl. ..... 206/141; 206/427; 206/429
(58) Field of Search ..... 206/140, 141, 206/145, 147, 427, 428, 429, 434, 435

(56) References Cited

U.S. PATENT DOCUMENTS 4,216,861 * 8/1980 Oliff ..... 206/427
4,234,081 * 11/1980 Champlin ..... 206/147
4,256,226 * 3/1981 Stone ..... 206/427
4,295,562 * 10/1981 Wood ..... 206/427
4,314,634 * 2/1982 Stone ..... 206/427
4,328,891 * 5/1982 Elward ..... 206/147
4,398,631 * 8/1983 Graser ..... 206/427
5,944,253 * 8/1999 Miller et al. ..... 206/429

* cited by examiner

*Primary Examiner*—Jim Foster

(57) ABSTRACT

The present invention is a wrap-around carrier for bottles that has a large opening with rounded corners in the end walls and has a sloping end panel on each end that slopes inwardly as it rises towards the top panel. This carrier may have a circular window or a rectangular window with rounded corners in each side wall. This carrier may also have a tear strip in the top panel and sloping end panels so that a substantial portion of the top panel and sloping end panels can be removed converting the carrier into a tray. This carrier may also have an elongated handle in the top panel with slits extending into the sloping end panels to dissipate the stress from carrying the carrier.

13 Claims, 3 Drawing Sheets

ARTICLE CARRIER WITH END WINDOWS

BACKGROUND OF THE INVENTION

1. Field of the Invention

The present invention relates to a wrap-around carrier for bottles. A large opening in each end wall is provided to increase the visibility of the bottles in the carrier. A large, preferably circular, window may be provided in each side wall for the purpose of providing maximum visibility of the bottles for aesthetic reasons. The top wall may have a tear off feature so as to tear off a portion of the top of the carrier leaving a tray for containing the bottles.

2. Background of the invention

Wrap-around carriers for glass bottles have been made for many years. With these carriers, it is desirable to provide maximum protection for glass bottles against breakage. It is also desirable to have a wrap-around carrier for bottles to provide maximum visibility of the bottles to the consumer, while providing adequate structural integrity for the carrier. It is desirable to have this visibility through the ends of the carriers, as it is common to stack carriers with only the ends visible. It is also desirable to have this visibility through the side walls of the carrier so consumers can better view the bottles. Yet, providing this visibility through the sides and ends of the carrier must not adversely affect the structural integrity of the carrier.

SUMMARY OF THE INVENTION

It is desirable to have greater visibility of bottles in a carrier as long as the structural characteristics of the carrier are not adversely affected. This is desirable from a marketing standpoint and also because it reduces the amount of board that is required to produce the carrier. Because carriers are sometimes displayed with their ends being visible, it is desirable to have a window in each of the ends of the carrier. It would also be desirable to have a window in each of the sides of the carrier so consumers can view the bottles contained therein.

It is an object of this invention to provide a carrier with a window in each end of the carrier without adversely affecting the structural characteristics of the carrier.

It is also an object of this invention to provide a carrier for bottles with a window in each side of the carrier without adversely affecting the structural characteristics of the carrier.

It is a further object of this invention to provide a carrier having both large end and side windows.

The objects of this invention have been achieved in a wrap-around carrier that has large windows in the end walls. This carrier may also have large windows in the side walls without adversely affecting its structural integrity. Preferably, the windows in the side walls are circular so carriers do not snag each other when they are stacked side-by-side in the store. The carrier of this invention has sloping upper end panels to better fit the contour of the bottles contained therein, which results in the formation of a tight package. The windows in the end walls have rounded corners in order to minimize the tearing of the carrier during stress.

This carrier further may be provided with a slotted handle to facilitate carrying, as a carrier containing twelve bottles may be too heavy for a handle with only two finger hold openings.

This carrier further may be converted into a tray by the provision of two tear strips in the top panel and sloping end panels, which tear strips permit the removal of a large portion of the top panel and sloping end panels from the carrier.

These and other objects, features and advantages of the present invention will become more apparent upon reading the following specification in conjunction with the accompanying drawing figures.

DETAILED DESCRIPTION OF THE PREFERRED EMBODIMENTS

The present invention is a wrap-around carrier primarily intended for carrying a plurality of bottles. This carrier can be formed from a single piece of foldable material, such as a blank cut out of paperboard. The layout of the blank is basically rectangular, which results in economizing the amount of paperboard used. Further, the blank preferably is symmetrical about a line of bisection running the length of the blank, as is apparent from FIG. 1. This symmetry may be invoked by listing like elements with the same reference number. It will be understood that the blank may not have such symmetry.

This carrier can be used for carrying from six to twenty-four bottles. This carrier is characterized by having an aperture (window) in each end for display purposes. These windows have rounded corners to minimize tearing of the carrier under stress. It may also have a tear strip to remove most of the top panel and sloping end panels, resulting in the formation of a tray.

In a second embodiment, this carrier also has a window in each side to better display the bottles contained therein. Preferably, these windows are circular to minimize snagging of the carriers when stacked side-by-side with other carriers.

A Carrier with Large Display Windows in the End Panels

Figure 1:
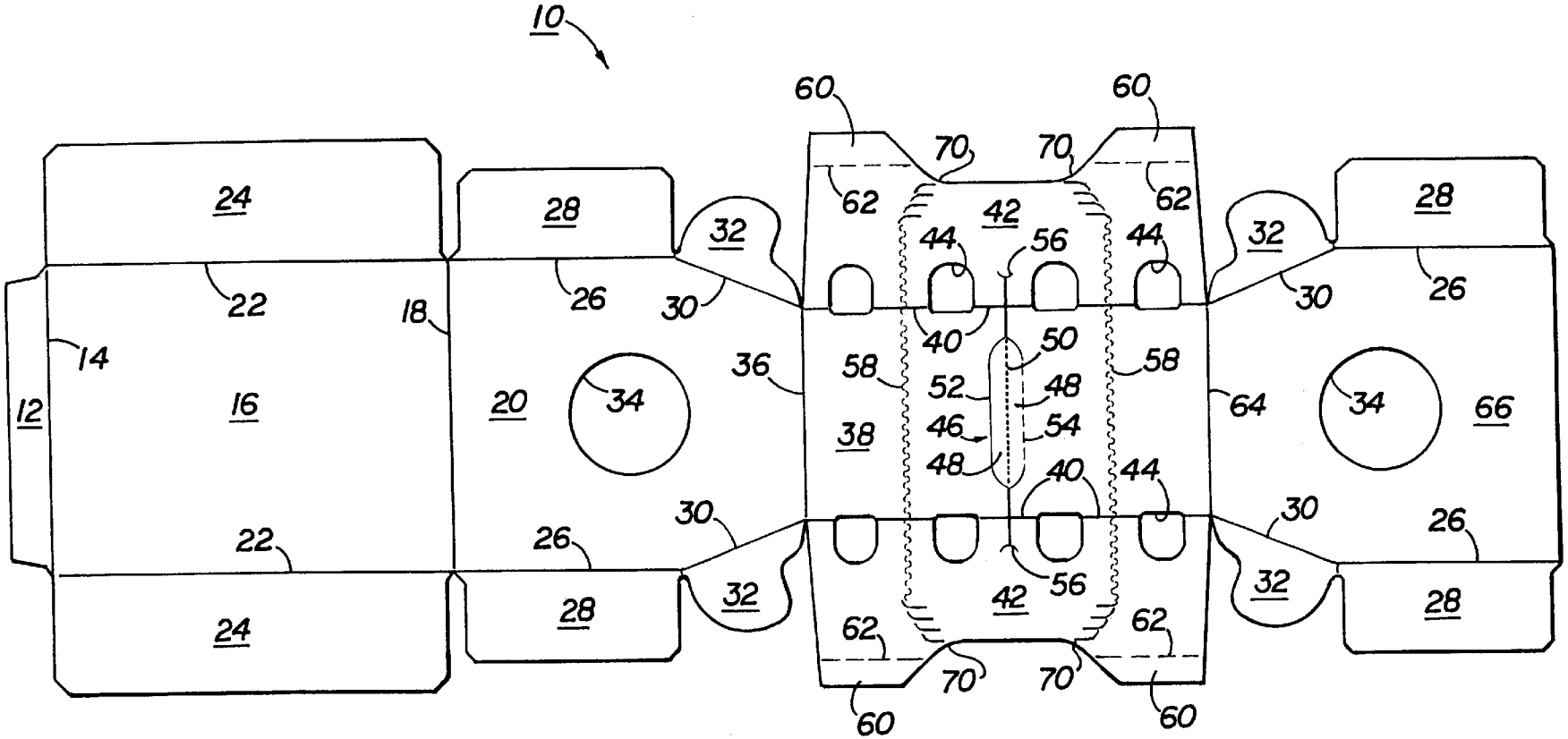
FIG. 1 is a plan view of a blank for forming the carrier of this invention.

Referring now to FIG. 1, the carrier of this invention may be formed from a blank 10. The blank has an inner face shown in FIG. 1, and an outer face (not shown), that may be coated for printing and display purposes. Generally from left to right, blank 10 comprises a glue panel 12, which is connected by fold line 14 to bottom panel 16, which in turn is connected by fold line 18 to first side panel 20. Bottom end panels 24 are attached to bottom panel 16 about fold lines 22.

First side end panels 28 are attached to first side panel 20 about fold lines 26. First upper end panels 32 are attached to first side panel 20 about sloping fold lines 30. Although FIG. 1 displays an aperture 34 cut from first side panel 20, such aperture is not a part of this embodiment.

Top panel 38 is connected to first side panel 20 along fold line 36. Top panel 38 is bounded by fold lines 36, 40 and 64.

Sloping end panels 42 are foldably connected along the length of top panel 38 by fold lines 40. Sloping end panel apertures 44 are formed in the sloping end panels 42 so the tops of the enclosed bottles may project slightly through the panels 42. FIG. 1 shows eight sloping end panel apertures 44, four in each sloping end panel 42. This facilitates the forming of a tight package and reduces the amount of paperboard that is used by virtue of the sloping characteristics of the sloping end panels 42.

Top panel 38 also has a slotted handle 46. Slotted handle 46 has two flaps 48 that are attached together by fold line 50. Slotted handle flap 48 nearest fold line 36 is separated from top panel 38 by cut line 52. The other slotted handle flap 48 is attached to top panel 38 by fold line 54. Flaps 48 fold inwardly when a hand is extended into the handle 46. These flaps may cushion the fingers while they hold the carrier. Cut line 52 continues past handle 46, extending outwardly from the ends of slotted handle 46 through top panel 38, and into sloping end panels 42, such to dissipate the stress from lifting into the sloping end panels 42. Semi-circular stress reducers 56 are provided at each end of cut line 52 to prevent unwanted tearing into sloping end panels 42.

Two tear lines 58 may be provided in top panel 38, which tear lines 58 further extend into sloping end panels 42. Tearing about these tear lines 58 facilitates the removal of a sufficient amount of the top panel 38 and sloping end panels 42 to permit the consumer to have access to the bottles contained in the carrier.

Top end flaps 60 are attached to sloping end panels 42 by fold lines 62. FIG. 1 shows four top end flaps 60, two per sloping end panel 42.

Second side panel 66 is shown as a mirror image of first side panel 20, and is connected to top panel 38 at fold line 64. For the sake of brevity and consistency, no further description of second side panel 66 is presented, and the same or similar elements found between first and second side panels 20, 66 will maintain the same reference numerals. Thus, for example, two second side end panels 28 are attached to second side panel 66 about fold lines 26. It will be clear, when distinction is necessary, that side end panels 28 will be described either as "first" side end panels 28 and/or "second" side end panels 28.

A Carrier with Windows on the End Panels and a Window in Each Side Panel

FIG. 1 discloses this particular embodiment that also includes apertures 34 (windows) in side panels 20 and 66. It is preferred that these windows 34 be circular so that when similar carriers are stacked side-by-side, there is no corner of the windows 34 to get snagged by an adjacent carrier. It should be realized that if snagging is not a problem, then apertures 34 can be, for example, rectangular windows 34, but preferably with rounded corners, which also tend to minimize the snagging.

Forming and Loading the Carrier

The blank 10 can be formed into a sleeve for loading bottles into by gluing glue panel 12 to second side panel 66 when the blank is manufactured. The packaging machine in the bottling plant can manipulate the blank 10 so that it forms a sleeve into which bottles B may be slid by a packaging machine, the bottles being shown in phantom lines in proximity to the carrier in FIG. 2.

Figure 2:
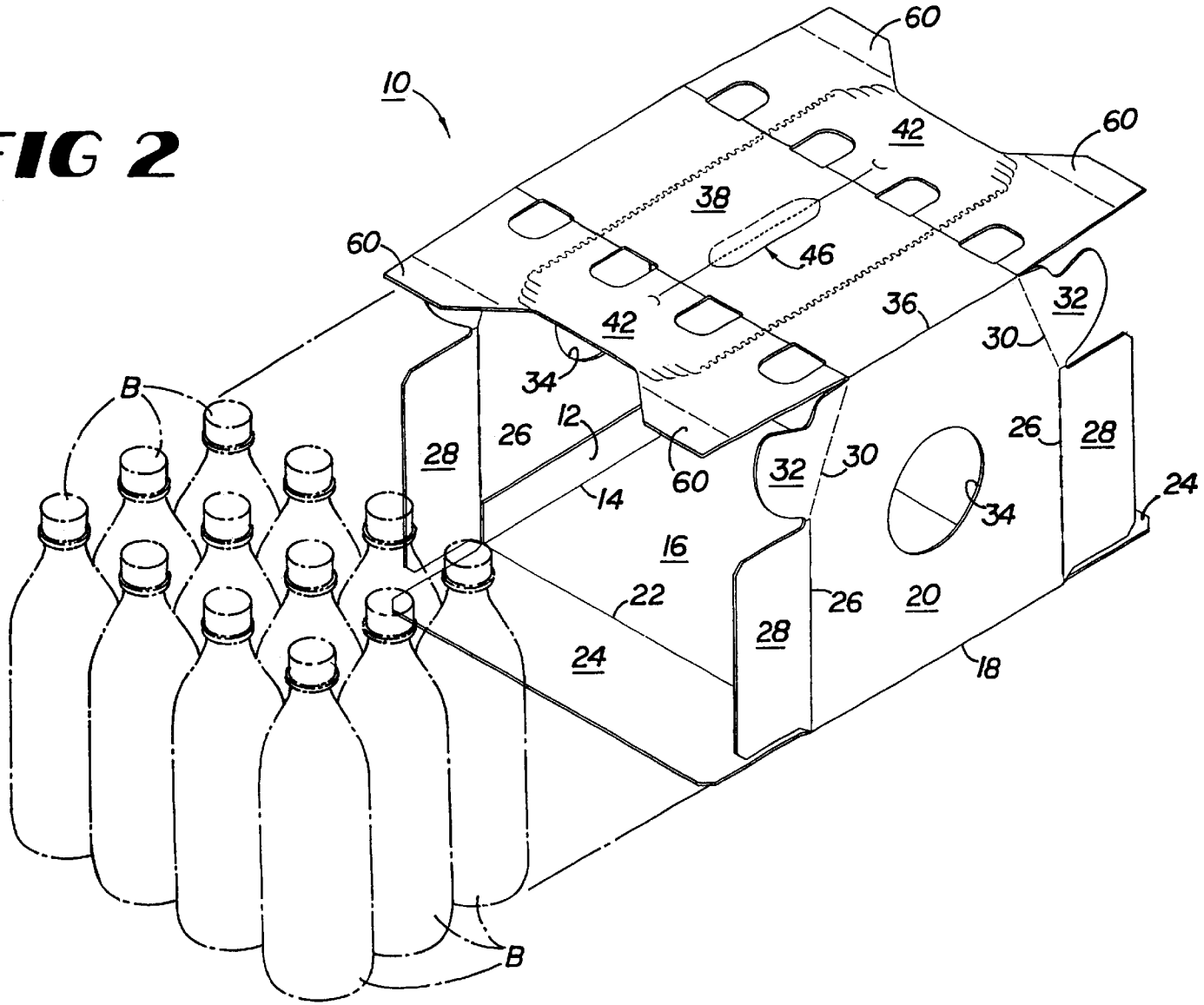
FIG. 2 is an end perspective view of a carrier of this invention, which carrier has been formed into a sleeve. Bottles are shown in the process of being slid into the sleeve.

The bottom end panels 24 and the several flaps/panels in proximity to the end of the carrier to be loaded need to be held in the open position while the bottles are being loaded. The side end panels 28, upper end panels 32, and sloping end panel 42 on the end of the carrier to be loaded need to be held in the open position while the bottles are being loaded. As illustrated in FIG. 2, it is the leftmost panels that need be in the open position, as that is the side the bottles B are slid into. After the bottles have been loaded, first and second side end panels 28, first and second and upper end panels 32 can be folded inwardly to bring them into contact with the bottles. Bottom end panels 24 are then folded upwardly and glued to the first and second side end panels 28.

Sloping end panels 42 on the end of the carrier loaded are folded downwardly and glued to the upper end panels 32, and top end flaps 60 are folded downwardly and glued to side end panels 28. It should be appreciated that first and second upper end panels 32 are sloped inwardly towards the top so fold lines 30 are coextensive with the slope of sloping end panels 42. The other end of the carrier is closed in the same manner at the same time. Both ends of the carrier are glued in the same way at the same time so that the pressure exerted on the end closures during gluing forms a tight package. In the embodiment that is shown, it will be noticed that the bottles are slid in two rows of four bottles in each row. These same principles apply when loading a different number of bottles into this style of carrier.

Unique Features of the Carrier of this Invention

Figure 3:
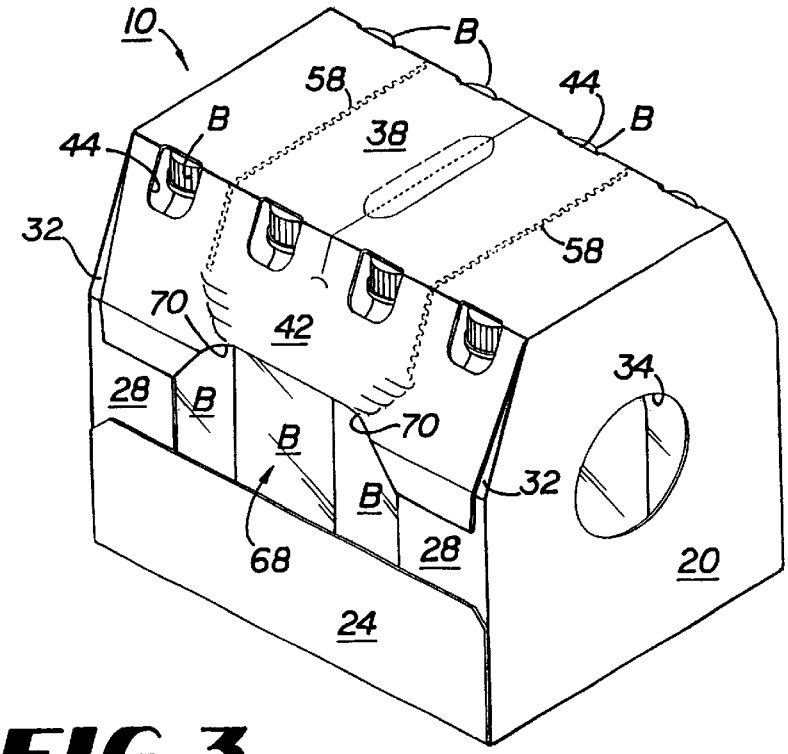
FIG. 3 is an end perspective view of a fully loaded carrier formed from the blank of FIG. 1.

Carriers with large openings in the end walls tend to be structurally weak. Applicant has been able to design a carrier that is structurally strong by utilizing a couple of features. As shown in FIG. 3, sloping end panels 42 and similarly sloping first and second upper end panels 32 form windows 68 which have rounded corners 70 in the sloping end panels 42. These rounded corners 70 tend to impede the windows 68 from tearing. It is possible to provide these windows 68 and yet maintain the structural integrity of the carrier by the use of sloping end panels 42 and first and second upper end panels 32 that also have a corresponding slope. The use of rounded corners 70 of the end windows 68 also adds to the structural integrity of the carrier. In addition, the provision of sloping end panel apertures 44 through which the necks of the bottles project aids in holding the carrier together as an integral structure with the bottles contained.

The amount of paperboard used is reduced by the use of sloping end panels 42. This is dramatically shown by the fact that the distance between the ends of the top panel 38 (score lines 40) is less than the distance between the ends of the bottom panel 16 (score lines 22).

Another embodiment of this invention includes the use of windows 34 in the side walls 20 and 66. If these windows 34 are made in a circular fashion, there is less likelihood of tearing when carriers are stacked side-by-side. Alternatively, these windows 34 may be rectangular (not shown) with rounded corners, which also tend to impede snagging with adjoining carriers.

Figure 4:
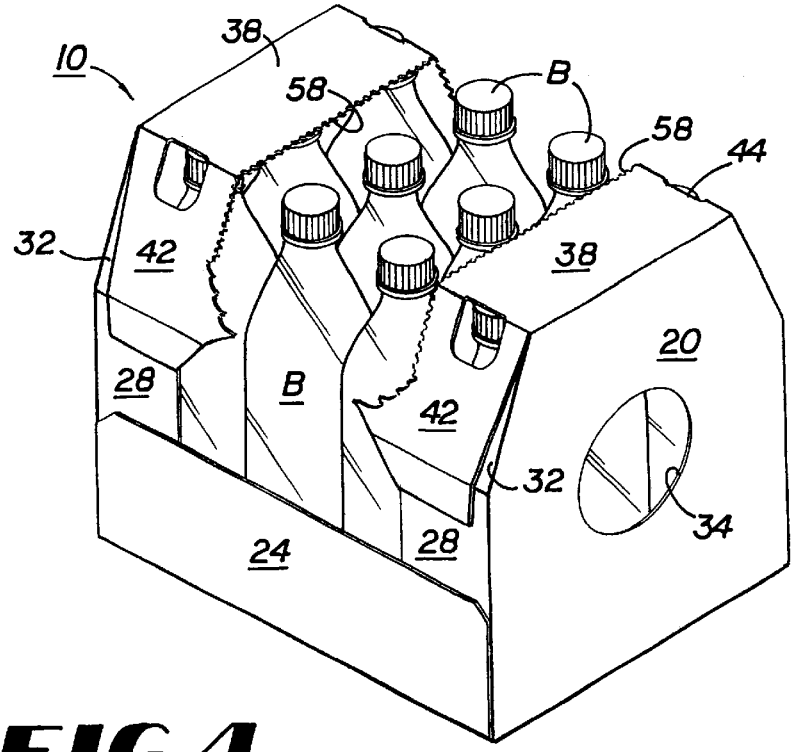
FIG. 4 is a perspective view of the carrier formed from the blank of FIG. 1, which carrier has been transformed into a tray by the removal of most of the top panel and sloping end panels.

As shown in FIG. 4, portions of the top panel 38 and sloping end panels 42 have been removed about tear lines 58, the portions having been torn out. This provides a tray that facilitates the removal of one or more bottles. Bottles can also be returned to the tray when their contents have consumed. Even though substantial portions of the top panel 38 and sloping end panels 42 have been removed, the tray is relatively stable because of the tight nature of the carrier's construction.

Because this carrier is heavy when filled with, for example, eight bottles, a slotted handle facilitates its carrying as the entire hand can be placed in the slotted handle 54, and the stresses are dissipated by slot 52 extending into sloping end panels 42.

While the invention has been disclosed in its preferred forms, it will be apparent to those skilled in the art that many modifications, additions and deletions can be made therein without departing from the spirit and scope of the invention and its equivalents as set forth in the following claims.

What is claimed is:

1. A wrap-around carrier for containing a plurality of bottles comprising:

a. a bottom panel with sides and ends, which bottom panel is attached at each side to a side panel, each side panel rising perpendicularly from the bottom panel and having ends and an upper side, said upper side being attached to a top panel which has ends, with the distance between the ends of the top panel being significantly less than the distance between ends of the bottom panel;

b. a bottom end closure adjacent each end of the bottom panel formed from a bottom end panel attached to each end of the bottom panel, a side end panel attached at each end of each side panel, said bottom end panels and side end panels being secured together by securing means to form the bottom end closure; and c. a top end closure adjacent each end of the top panel formed from an upper end panel attached to each side panel, a sloping end panel attached to the end of the top panel, said sloping end panel sloping inwardly as it rises towards the top panel, said sloping end panel having an end which is attached to flaps, said sloping end panels and upper end panels and flaps being secured together by the securing means to form the top end closure, said bottom end closure and top end closure on each end forming the perimeter of a window with the portion of the perimeter in the sloping end panel having rounded corners.

2. The carrier of claim 1, wherein the securing means is glue.

3. The carrier of claim 1, wherein the top panel and sloping end panels have tear strips to permit the removal of a substantial portion of the top panel and sloping end panels to transform the carrier into a tray.

4. The carrier of claim 1, wherein there are apertures in the sloping end panels for the extension of a portion of the necks of the bottles adjacent the ends of the top panel.

5. The carrier of claim 1, which has an elongated handle cut from the top panel with the handle having at least one flap attached to the top wall and having slits from each end of the handle extending through each end of the top wall and into the sloping end panels.

6. The carrier of claim 5, which has a cut substantially perpendicular to each slit in each sloping end panel to impede any tearing in the sloping end panels.

7. The carrier of claim 1, wherein there is a window in at least one side panel.

8. The carrier of claim 7, wherein there is a window in each side panel, and the window is circular in form.

9. The carrier of claim 8, wherein the securing means is glue.

10. The carrier of claim 8, wherein the top panel and sloping end panels have tear strips to permit the removal of a substantial portion of the top panel and sloping end panels to transform the carrier into a tray.

11. The carrier of claim 8, wherein there are apertures in the sloping end panels for the extension of a portion of the necks of the bottles adjacent the ends of the top panel.

12. The carrier of claim 8, which has an elongated handle cut from the top panel with the handle having at least one flap attached to the top wall and having slits from end of the handle extending through each end of the top wall and into the sloping end panels.

13. The carrier of claim 8, which has a cut substantially perpendicular to each slit in each sloping end panel to impede any tearing in the sloping end panel.

* * * * *